US006223657B1

(12) United States Patent
Proffitt

(10) Patent No.: US 6,223,657 B1
(45) Date of Patent: May 1, 2001

(54) SIMULATED AMMUNITION

(75) Inventor: Jeffery K. Proffitt, Greenback, TN (US)

(73) Assignee: Andrew R. Proffitt, Greenback, TN (US)

( * ) Notice: Subject to any disclaimer, the term of this patent is extended or adjusted under 35 U.S.C. 154(b) by 0 days.

(21) Appl. No.: 09/239,126

(22) Filed: Jan. 28, 1999

(51) Int. Cl.[7] ..... F42B 8/00
(52) U.S. Cl. ..... 102/444; 42/96; 42/106
(58) Field of Search ..... 102/444; 42/90, 42/96, 106; 89/1.1; 29/1.2

(56) References Cited

U.S. PATENT DOCUMENTS

| | | | | |
|---|---|---|---|---|
| 2,405,308 | | 8/1946 | Jack | 35/25 |
| 2,882,821 | * | 4/1959 | Benson | 102/444 |
| 3,027,840 | * | 4/1962 | Hannas et al. | 102/444 |
| 3,785,293 | | 1/1974 | Barr et al. | 102/92.7 |
| 3,848,350 | | 11/1974 | Seminiano | 42/1 N |
| 4,100,693 | | 7/1978 | Cech | 42/1 N |
| 4,233,902 | | 11/1980 | Hartley et al. | 102/41 |
| 4,450,769 | * | 5/1984 | Moser | 102/444 |
| 4,486,966 | | 12/1984 | Seehase | 42/1 N |
| 4,776,123 | | 10/1988 | Ascroft | 42/70.11 |
| 4,965,952 | | 10/1990 | Miller et al. | 42/70.01 |
| 5,097,613 | | 3/1992 | Miller et al. | 42/70.01 |
| 5,291,832 | | 3/1994 | Plummer | 102/444 |
| 5,435,090 | | 7/1995 | Darrow | 42/95 |

* cited by examiner

*Primary Examiner*—J. Woodrow Eldred
(74) *Attorney, Agent, or Firm*—Luedeka, Neely & Graham, P.C.

(57) ABSTRACT

A simulated ammunition device which includes a first portion having a longitudinal axis and a blind bore provided therein at a location co-axial with the longitudinal axis of the first portion; a second portion having a longitudinal axis, a head which is substantially cylindrical in shape and includes a circumferential rim, and a stud which extends co-axial to the longitudinal axis of the second portion, the stud being received by the blind bore of the first portion; and structure for maintaining the stud within the blind bore.

28 Claims, 3 Drawing Sheets

SIMULATED AMMUNITION

FIELD OF THE INVENTION

This invention relates generally to simulated ammunition devices. More particularly, this invention relates to simulated shotgun shells and simulated centerfire rounds having a realistic appearance, feel and weight.

BACKGROUND AND SUMMARY OF THE INVENTION

Law enforcement agencies, hunter safety organizations and others often provide firearm safety training in an effort to reduce the incidence of firearm related accidents. Safe use of shotguns, rifles and pistols is often demonstrated in such training, with such training including instruction in loading ammunition into the firearm and unloading unfired ammunition from firearm. It is undesirable to use actual live shotgun shells and rifle and pistol rounds for training in view of the inherent safety risks. In an attempt to simulate a shotgun shell, it is common for instructors to use previously fired and now empty shotgun shells, the casings of which have been re-crimped. However, empty shells do not adequately simulate a live round. Likewise, the use of empty centerfire pistol and rifle rounds is not adequate.

Accordingly, it is an object of the invention to provide simulants having an appearance, feel and weight which provide realistic simulation of ammunition.

It is another object of the invention to provide simulants of the character described which avoid separation of the components thereof during use of the simulants for training purposes.

A further object of the invention is to provide simulants of the character described which simulate shotgun shells.

A still further object of the invention is to provide simulants of the character described which simulate centerfire ammunition.

Yet another object of the invention is to provide simulants of the character described which are uncomplicated in configuration.

With regard to the foregoing, the present invention is directed to a firearm ammunition simulant.

In a preferred embodiment, simulated ammunition in accordance with the invention includes a first portion having a longitudinal axis and a bore provided therein at a location co-axial with the longitudinal axis of the first portion; a second portion having a longitudinal axis and including a head which is substantially cylindrical in shape and includes a circumferential rim, and a stud which extends from the head opposite from the rim and co-axial to the longitudinal axis of the second portion, the stud being received by the bore of the first portion; and structure for maintaining the stud within the bore.

In one embodiment, the stud and the bore threadably engage to provide a connection between the first portion and the second portion that avoids accidental separation of the first and second portions.

In another embodiment, the stud includes projections or barbs or the like which engage sidewalls of the bore such that the first portion and the second portion may be joined as by press-fitting to provide a connection between the first portion and the second portion that avoids accidental separation of the first and second portions.

The first portion is preferably made of a polymeric material, such as nylon, and the second portion is preferably made of a metallic material, such as brass.

Simulated ammunition in accordance with the invention may be made to simulate shotgun shells, centerfire rifle and pistol ammunition and other ammunition.

To simulate a shotgun shell, the first portion is configured to resemble the case or hull of a shotgun shell and the second portion is configured to resemble the brass or base portion of a shotgun shell.

To simulate centerfire ammunition, the first portion is configured to resemble the casing/bullet portion of centerfire ammunition and the second portion configured to resemble the base portion of centerfire ammunition where the primer is located.

The invention advantageously provides simulated ammunition which closely resembles the ammunition it simulates in appearance, feel and weight so as to give a realistic simulation experience. In addition, simulants in accordance with the invention avoid are configured such that separation of the components are avoided.

BRIEF DESCRIPTION OF THE DRAWINGS

The above and other features and advantages of the present invention will become further known from the following detailed description considered in conjunction with the accompanying drawings in which.

DETAILED DESCRIPTION

Figure 1:
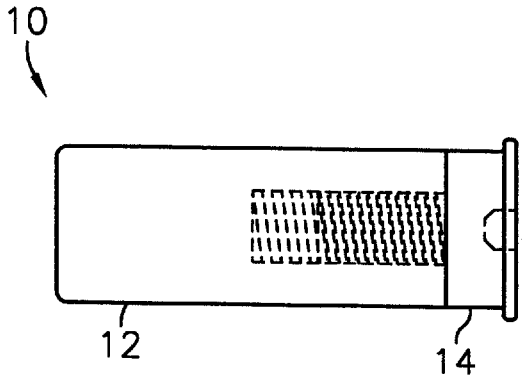
FIG. 1 is an elevational side view of a shotgun shell simulant in accordance with a preferred embodiment of the invention.

With initial reference to FIG. 1, there is shown a shotgun shell simulant 10 having a case or hull portion 12 and a base portion 14. The simulant 10 has an appearance, feel and weight which provides realistic simulation of a live or loaded shotgun shell. Advantageously, the hull portion 12 is fixedly secured to the base portion 14 in a manner that avoids accidental separation of the hull portion 12 from the base portion 14.

Avoidance of accidental separation is desirable to render the shell simulant 10 suitable for training purposes with a variety of shotguns including those having a pump action wherein shells are cycled from a magazine of a shotgun to a firing chamber and then ejected by operation of the pump action by a user. It would be undesirable for separation of the components to occur, i.e., separation of the hull and base portions, since one or both of the components could remain in the shotgun and render it unusable or unsafe for subsequent use with live ammunition.

Figure 2:
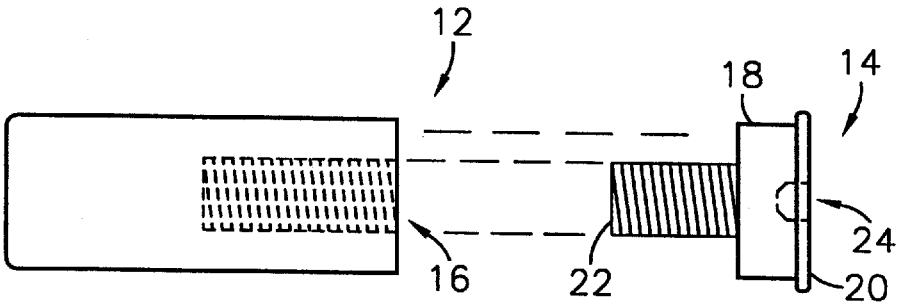
FIG. 2 is an exploded side view of the shotgun shell simulant of FIG. 1.
Figure 3:
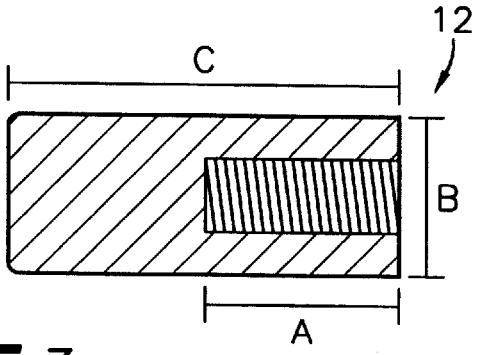
FIG. 3 is a cross-sectional view of a hull portion of the shell simulant of FIG. 1.
Figure 4:
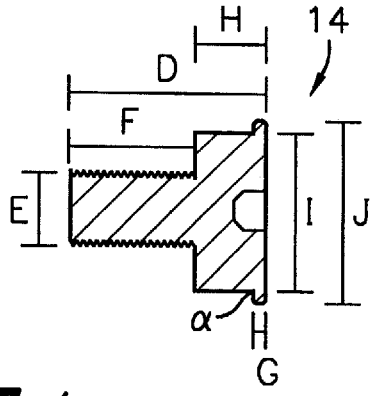
FIG. 4. is a cross-sectional view of a base portion of the shell simulant of FIG. 1.

Turning to FIGS. 2, 3 and 4, the hull portion 12 is preferably of solid, one-piece construction, preferably made of a plastic or polymeric material, most preferably nylon, using known molding techniques. The hull portion 12 is substantially cylindrical in shape to correspond in size and shape to the hull portion 12 of a shotgun shell. The hull portion 12 includes a threaded, preferably blind bore 16 co-axial to the center line of the hull portion and open at one end of the hull portion 12 for receiving a corresponding portion of the base 14. The bore 16 may be provided, as by drilling and threading.

The base portion 14 is preferably of solid, one-piece construction, preferably made of a metallic material, most preferably brass, using known milling or turning techniques. The base portion 14 includes a head 18 which is substantially cylindrical in shape and includes a circumferential rim 20 to simulate the appearance and external structure of the base portion of a shotgun shell. The base portion 14 includes a stud 22 extending co-axial to the center line of the base portion and threaded so as to be threadably receivable within the blind bore 16 of the hull portion 12.

A bore 24 is also preferably centrally provided on the head 18 opposite the stud 22 as clearance for a firing pin of a shotgun so that the shotgun may be dry fired when the simulated shell 10 is positioned within a firing chamber of the shotgun. Additionally, a resilient energy absorbing material, such as foam or a spring, may be placed within the bore 24 for dry firing purposes for avoiding damage to the firing pin of the shotgun.

For the purpose of an example, the hull 12 is preferably dimensioned as set forth in Table 1 below to simulate the hull of a 12 gauge shotgun shell. It will be appreciated that the hull 12 may be provided in various dimensions to enable its use with various other gauges such as 16 gauge, 20 gauge, 28 gauge and 410 bore shotguns.

TABLE 1

| Dimension | Inches |
|---|---|
| A | 1.0 length, 0.3125 inch diameter and threaded (⅜-16 thread) |
| B | 0.78 |
| C | 1.95 |

Likewise, the base 14 is preferably dimensioned as set forth in Table 2 below to simulate the base or brass portion of a 12 gauge shotgun shell.

TABLE 2

| Dimension | Inches |
|---|---|
| D | 0.975 |
| E | 0.375 |
| F | 0.650 (⅜-16 thread) |
| α | 95° |
| G | 0.050 |
| H | 0.325 |
| I | 0.800 |
| J | 0.881 |

The hull portion 12 as configured above preferably has a weight of from about 13 grams to about 19 grams and the base portion 14 as configured above preferably has a weight of from about 32 grams to about 36 grams, such that the overall weight of the simulated shell is from about 47 grams to about 53 grams. It has been observed that this range substantially approximates the typical weight range of shotgun shells, whose weight generally varies from about 41 grams to about 67 grams, depending on the powder and shot charge and other characteristics of the shotgun shell.

Figure 5:
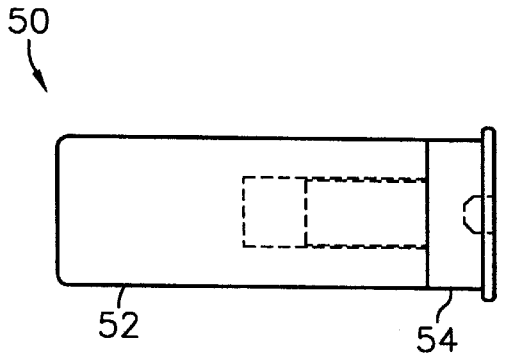
FIG. 5 is an elevational side view of a shotgun shell simulant in accordance with another embodiment of the invention.

With reference now to FIG. 5, there is shown an alternate embodiment of a shotgun shell simulant 50 having a hull portion 52 and a base portion 54. The simulant 50 also has an appearance, feel and weight which provides realistic simulation of a live shotgun shell. Advantageously, the hull portion 52 is fixedly secured to the base portion 54 in a manner that avoids accidental separation of the hull portion 52 from the base portion 54.

Figure 6:
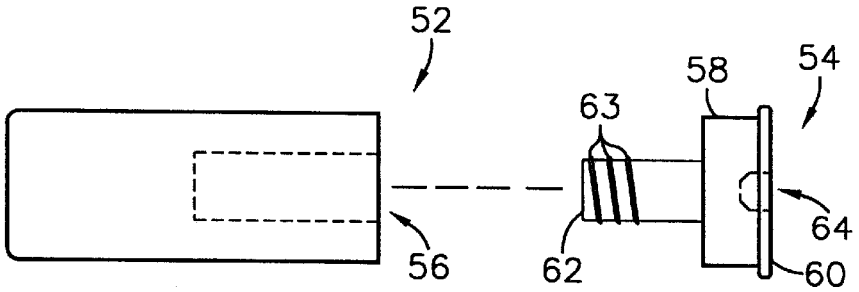
FIG. 6 is an exploded side view of the shotgun shell simulant of FIG. 5.
Figure 7:
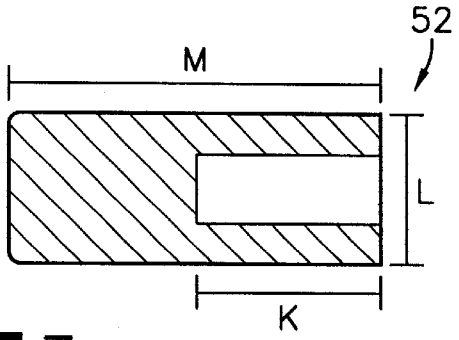
FIG. 7 is a cross-sectional view of a hull portion of the shell simulant of FIG. 5.
Figure 8:
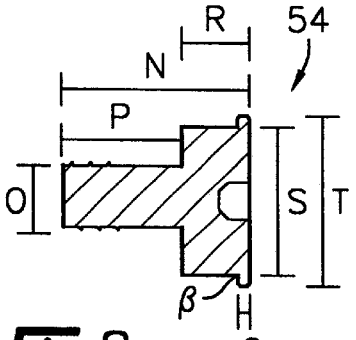
FIG. 8 is a cross-sectional view of a base portion of the shell simulant of FIG. 5.

Turning to FIGS. 6, 7 and 8, the hull portion 52 is preferably of solid, one-piece construction, preferably made of a plastic or polymeric material, most preferably nylon, using known molding techniques. The hull portion 52 is substantially cylindrical in shape to correspond in size and shape to the hull portion of a shotgun shell. The hull portion 52 includes a blind bore 56 co-axial to the center line of the hull portion and open at one end of the hull portion 52 for receiving a corresponding portion of the base 54. The bore 56 may be provided, as by drilling, and is preferably of smooth bore.

The base portion 54 is preferably of solid, one-piece construction, preferably made of a metallic material, most preferably brass, using known turning or milling techniques. The base portion 54 includes a head 58 which is substantially cylindrical in shape and includes a circumferential rim 60 to simulate the appearance of the base portion of a shotgun shell. The base portion 54 includes a stud 62 extending co-axial to the center line of the base portion and configured so as to be receivable within the blind bore 56 of the hull portion 52. In this regard, the stud 62 preferably includes a plurality of projections or protrusions such as annular rings, serrations or angled barbs 63 for frictionally and mechanically engaging the sidewalls of the bore 56 of the hull portion 52 to retain the stud 62 within the bore 56. The shell simulant 50 may be readily assembled by press-fitting the stud 62 into the bore 56, the barbs 63 being of sufficient dimension to provide a fit sufficient to maintain the assembly of the shell 50 during use of the shell as a training device with shotguns.

A blind bore 64 is also preferably centrally provided on the head 58 opposite the stud 62 as clearance for a firing pin of a shotgun so that the shotgun may be dry fired when the simulated shell 50 is positioned within the firing chamber of the shotgun.

Figure 14:
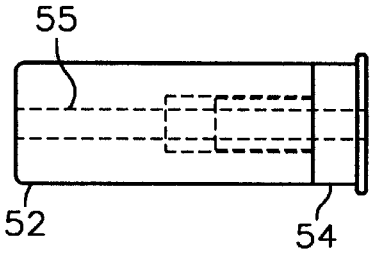
FIG. 14 is an exploded side view of an embodiment of the shell of FIG. 5 which enables a primer to be used in combination with the simulant.

The bore 64 (and blind 24) is preferably blind. However, it will be understood that the bore 64 may be made contiguous through the stud 62 and communicate with the bore 56, which may be extended to communicate with the other end of the hull portion. This would provide a continuous open bore 55 such that a live primer could be seated in the bore 64 (or bore 24) and fired to simulate firing of the shotgun. See, FIG. 14.

For the purpose of an example, the hull 52 is preferably dimensioned as set forth in Table 3 below to simulate the hull of a 12 gauge shotgun shell. It will be appreciated that the hull 52 may be provided in various dimensions to enable its use with various other gauges such as 16 gauge, 20 gauge and 410 bore shotguns.

TABLE 3

| Dimension | Inches |
|---|---|
| K | 1.0 length, 0.3125 inch diameter |
| L | 0.78 |
| M | 1.95 |

Likewise, the base 54 is preferably dimensioned as set forth in Table 4 below to simulate the base or brass portion of a 12 gauge shotgun shell.

TABLE 4

| Dimension | Inches |
|---|---|
| N | 0.975 |
| O | 0.375 |
| P | 0.650 |
| β | 95° |
| Q | 0.050 |
| R | 0.325 |
| S | 0.800 |
| T | 0.881 |

The shell 50 (and the components thereof) has a weight which substantially corresponds to that of the shell 10 (and components thereof) as previously described.

Figure 9:
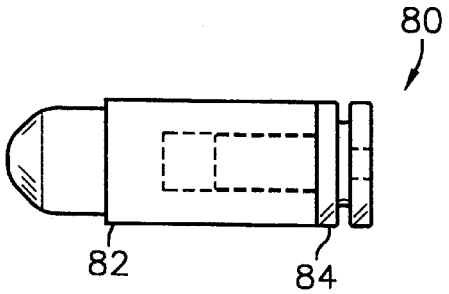
FIG. 9 is an elevational side view of a centerfire ammunition simulant in accordance with another embodiment of the invention.

With reference now to FIG. 9, there is shown an alternate embodiment of an ammunition simulant 80 having a casing/bullet portion 82 and a base portion 84. The simulant 80 also has an appearance, feel and weight which provides realistic simulation of live centerfire ammunition. Advantageously, the casing/bullet portion 82 is fixedly secured to the base portion 84 in a manner that avoids accidental separation of the casing/bullet portion 82 from the base portion 84.

Figure 10:
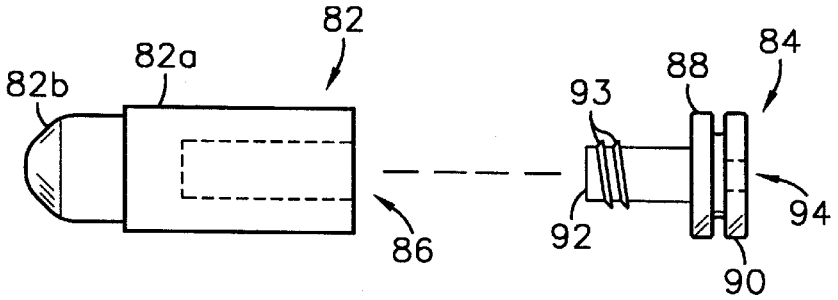
FIG. 10 is an exploded side view of the simulant of FIG. 9.
Figure 11:
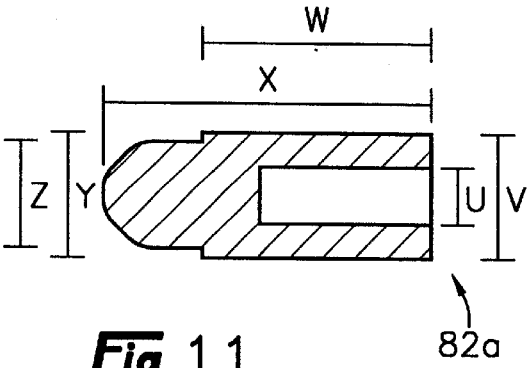
FIG. 11 is a cross-sectional view of a casing/bullet portion of the shell simulant of FIG. 9.
Figure 12:
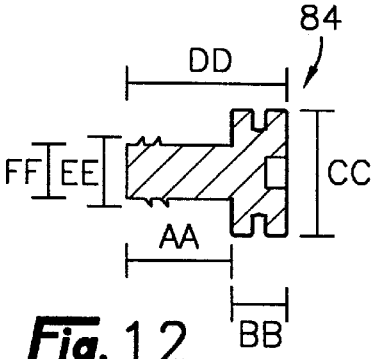
FIG. 12 is a cross-sectional view of a base portion of the shell simulant of FIG. 9.

Turning to FIGS. 10, 11 and 12, the casing(bullet portion 82 is preferably of solid, one-piece construction, preferably made of a plastic or polymeric material, most preferably nylon, using known molding techniques. The casing/bullet portion 82 has a substantially cylindrical casing portion 82*a*, the exterior of which corresponds in size and shape to the exterior of the casing portion of a conventional centerfire ammunition round and a bullet portion 82*b* which corresponds in size and shape to the exposed portion of a bullet as seated in a conventional centerfire round. The casing/bullet portion 82 includes a preferably blind bore 86 co-axial to the center line of the casing/bullet portion and open at one end of the casing/bullet portion 82 for receiving a corresponding portion of the base 84. The bore 86 may be provided, as by drilling, and is preferably of smooth bore.

The base portion 84 is preferably solid, one-piece construction, preferably made of a metallic material, most preferably brass, using known milling techniques. The base portion 84 includes a head 88 having a circumferential groove/rim 90 to simulate the appearance of the base portion of centerfire ammunition. The base portion 84 includes a stud 92 extending co-axial to the center line of the base portion and configured so as to be receivable within the bore 86 of the casing/bullet portion 82. In this regard, the stud 92 preferably includes a plurality of protrusions such as annular rings or angled barbs 93 for frictionally and mechanically engaging the sidewalls of the bore 86 of the casing/bullet portion 82 to retain the stud 92 within the bore 86. The shell simulant 80 may be readily assembled by press-fitting the stud 92 within the bore 86 to provide a fit sufficient to maintain the assembly of the shell 80 during use of the shell as a training device with centerfire firearms.

Figure 13:
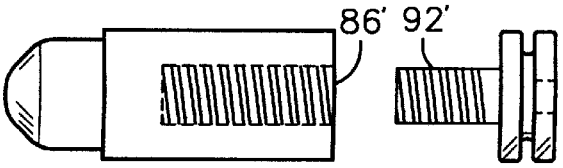
FIG. 13 is an exploded side view of another embodiment of a centerfire ammunition simulant.

Alternatively, as shown in FIG. 13, the simulant 80 may include a stud 92' which is threaded and a bore 86' having receiving threads in the manner previously described in connection with the simulant 10.

A blind bore 94 is also preferably centrally provided on the head 88 opposite the stud 92 as clearance for a firing pin of a centerfire pistol or rifle so that the pistol or rifle may be dry fired when the simulated shell 80 is positioned within the firing chamber of the firearm. The bore 94 may also be made contiguous with the bore 86 to provide a continuous bore for enabling use of a primer.

For the purpose of an example, the casing/bullet 82 is preferably dimensioned as set forth in Table 5 below to simulate the casing/bullet of a 9 mm Luger centerfire pistol round. It will be appreciated that the casing/bullet 82 may be provided in various dimensions to enable its use with various other centerfire pistol and rifle calibers, e.g., 45 cal., 30-06 Springfield and the like.

TABLE 5

| Dimension | Inches |
|---|---|
| U | 0.5 - depth, .221 - diameter |
| V | 0.387 |
| W | 0.545 |
| X | 0.800 |
| Y | 0.335 |
| Z | 0.325 |

Likewise, the base 84 is preferably dimensioned as set forth in Table 6 below to simulate the base of a 9 mm centerfire pistol round.

TABLE 6

| Dimension | Inches |
|---|---|
| AA | 0.370 |
| BB | 0.160 |
| CC | 0.387 |
| DD | 0.530 |
| EE | 0.224 |
| FF | 0.187 |

The casing/bullet portion 82 as configured above preferably has a weight of from about 0.03 oz. to about 0.07 oz. and the base portion 84 as configured above preferably has a weight of from about 0.015 oz. to about 0.025 oz., such that the overall weight of the simulated shell is from about 0.02 oz. to about 0.03 oz. It has been observed that this range substantially approximates the typical weight of 9 mm centerfire pistol rounds, which generally weigh from about 0.03 oz. to about 0.04 oz., depending on the bullet weight.

Ammunition simulants in accordance with the invention are suitable for use in conventional firearms for training purposes and are compatible with the mechanisms thereof.

That is, the simulants are configured so that they mechanically cooperate with magazine, feed and ejection mechanisms of conventional firearms in the same manner as ammunition does. This enables the actions of the firearms, such as the pump or lever action of a firearm, to be operated to cycle the simulants through the firearm in the same manner as live ammunition for the purpose of training.

The foregoing description of certain embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A shotgun shell simulant, comprising:

a solid, one-piece, substantially cylindrical hull portion having a longitudinal axis and a threaded blind bore provided therein at a location co-axial with the longitudinal axis of the hull portion; and a solid, one piece base portion having a longitudinal axis, a head which is substantially cylindrical in shape and includes a circumferential rim, a threaded stud which extends co-axial to the longitudinal axis of the base portion, the threaded stud being threadably received by the threaded blind bore of the hull portion so that the hull portion and base portion are fixedly secured and directly connected to one another, thereby substantially preventing separation thereof and relative movement there between, wherein the simulant has an appearance, feel and weight which provides realistic simulation of a live shotgun shell.

2. The shotgun shell simulant of claim 1, further comprising a blind bore centrally provided on the head opposite the stud as clearance for a firing pin of a shotgun with which the shotgun shell simulant is used.

3. The shotgun shell simulant of claim 1, wherein the hull portion is plastic.

4. The shotgun shell simulant of claim 1, wherein the base portion is metal.

5. The shotgun shell simulant of claim 1, wherein the shotgun simulant is sized to correspond to a 12 gauge shotgun shell and has a weight of from about 46 grams to about 56 grams.

6. A shotgun shell simulant, comprising:

a solid, one-piece, substantially cylindrical hull portion having longitudinal axis and including a blind bore provided therein at a location co-axial with the longitudinal axis of the hull portion, the blind bore having a sidewall; and a solid, one piece base portion having a longitudinal axis, a head which is substantially cylindrical in shape and includes a circumferential rim, a stud which extends co-axial to the longitudinal axis of the base portion, the stud being received by the blind bore of the hull portion, and one or more protrusions extending outwardly from the stud for engaging the sidewall of the blind bore of the hull portion to maintain the stud within the blind bore so that the hull portion and base portion are fixedly secured and directly connected to one another, thereby substantially preventing separation thereof and relative movement there between, wherein the simulant has an appearance, feel and weight which provides realistic simulation of a live shotgun shell.

7. The shotgun simulant of claim 6, wherein the protrusions comprise angled barbs.

8. The shotgun shell simulant of claim 6, wherein the hull portion is plastic.

9. The shotgun shell simulant of claim 6, wherein the base portion is metal.

10. The shotgun shell simulant of claim 6, wherein the shotgun simulant is sized to correspond to a 12 gauge shotgun shell and has a weight of from about 46 grams to about 53 grams.

11. A shotgun shell simulant, comprising:

a solid, one-piece, substantially cylindrical hull portion having a longitudinal axis and including a blind bore provided therein at a location co-axial with the longitudinal axis of the hull portion; and a solid, one piece base portion having a longitudinal axis, a head which is substantially cylindrical in shape and includes a circumferential rim, a stud which extends co-axial to the longitudinal axis of the base portion, the stud being received by the blind bore of the hull portion, and means for maintaining the stud within the blind bore so that the hull portion and base portion are fixedly secured and directly connected to one another, thereby substantially preventing separation thereof and relative movement there between, wherein the simulant has an appearance, feel and weight which provides realistic simulation of a live shotgun shell.

12. The shotgun shell simulant of claim 11, further comprising a blind bore centrally provided on the head opposite the stud as clearance for a firing pin of a shotgun with which the shotgun shell simulant is used.

13. The shotgun shell simulant of claim 11, wherein the hull portion is plastic.

14. The shotgun shell simulant of claim 11, wherein the base portion is metal.

15. The shotgun shell simulant of claim 11, wherein the shotgun simulant is sized to correspond to a 12 gauge shotgun shell and has a weight of from about 46 grams to about 53 grams.

16. The shotgun shell simulant of claim 11, wherein the means for maintaining the stud within the blind bore comprises a threaded bore and matingly threaded stud.

17. The shotgun shell simulant of claim 11, wherein the means for maintaining the stud within the blind bore comprises one or more protrusions extending outwardly from the stud for engaging a sidewall of the blind bore.

18. An ammunition simulant, comprising:

a first portion having a longitudinal axis and a bore provided therein at a location co-axial with the longitudinal axis of the first portion; and a solid, one piece base portion having a longitudinal axis, a head which is substantially cylindrical in shape and includes a circumferential rim, a stud which extends from the head opposite from the rim and co-axial to the longitudinal axis of the base portion, the stud being received by the bore of the first portion; and means for maintaining the stud within the bore so that the hull portion and base portion are fixedly secured and directly connected to one another, thereby substantially preventing separation thereof and relative movement there between, wherein the simulant has an appearance, feel and weight which provides realistic simulation of live ammunition.

19. The simulant of claim 18, wherein the means for maintaining the stud within the blind bore comprises a threaded bore and matingly threaded stud.

20. The simulant of claim 18, wherein the means for maintaining the stud within the blind bore comprises one or more protrusions extending outwardly from the stud for engaging a sidewall of the bore.

21. The simulant of claim 18, wherein the simulant simulates a shotgun shell.

22. The simulant of claim 18, wherein the simulant simulates centerfire ammunition.

23. The simulant of claim 18, wherein the bore is a blind bore.

24. The simulant of claim 18, further comprising a bore centrally provided on the head and configured to receive a live primer and continuous through the head so as to be in flow communication with the bore of the first portion, with the bore of the first portion being continuous through the first portion and opening to the atmosphere.

25. A centerfire ammunition simulant, comprising:

a solid, one-piece, first portion having a substantially cylindrical section having a longitudinal axis and including a blind bore provided therein at a location co-axial with the longitudinal axis of the cylindrical section and opening to a first end thereof, and a rounded section corresponding substantially in shape to the shape of a centerfire projectile and extending in longitudinal alignment with the blind bore opposite the first end; and a solid, one piece base portion having a longitudinal axis, a head which is substantially cylindrical in shape and includes a circumferential rim adjacent a circumferential groove, a stud which extends co-axial to the longitudinal axis of the base portion, the stud being received by the blind bore of the first portion, and means for maintaining the stud within the blind bore so that the hull portion and base portion are fixedly secured and directly connected to one another, thereby substantially preventing separation thereof and relative movement there between, wherein the simulant has an appearance, feel and weight which provides realistic simulation of live centerfire ammunition.

26. The simulant of claim 25, further comprising a blind bore centrally provided on the head opposite the stud as clearance for a firing pin of a shotgun with which the simulant is used.

27. The simulant of claim 25, wherein the means for maintaining the stud within the blind bore comprises a threaded bore and matingly threaded stud.

28. The simulant of claim 25, wherein the means for maintaining the stud within the blind bore comprises one or more protrusions extending outwardly from the stud for engaging a sidewall of the blind bore.

* * * * *